US008479339B2

(12) United States Patent
Stoltz

(10) Patent No.: US 8,479,339 B2
(45) Date of Patent: Jul. 9, 2013

(54) SWIMMING POOL CLEANERS AND COMPONENTS THEREOF

(75) Inventor: Gerhardus Johannes Stoltz, Temecula, CA (US)

(73) Assignee: Zodiac Pool Systems, Inc., Vista, CA (US)

( * ) Notice: Subject to any disclaimer, the term of this patent is extended or adjusted under 35 U.S.C. 154(b) by 397 days.

(21) Appl. No.: 12/661,380

(22) Filed: Mar. 17, 2010

(65) Prior Publication Data

US 2011/0225747 A1 Sep. 22, 2011

(51) Int. Cl.
*E04H 4/16* (2006.01)

(52) U.S. Cl.
USPC ..... 15/1.7; 15/246

(58) Field of Classification Search
USPC ..... 15/1.7, 246
See application file for complete search history.

(56) References Cited

U.S. PATENT DOCUMENTS

| | | | | |
|---|---|---|---|---|
| 4,949,419 | A | 8/1990 | Kallenbach | |
| 5,014,382 | A | 5/1991 | Kallenbach | |
| 5,418,995 | A | 5/1995 | Rice et al. | |
| 5,421,054 | A | 6/1995 | Dawson et al. | |
| 5,433,985 | A | 7/1995 | Atkins | |
| 5,465,443 | A | 11/1995 | Rice et al. | |
| 5,617,606 | A | 4/1997 | Scott, II et al. | |
| 5,882,512 | A | 3/1999 | Denkewicz et al. | |
| 6,049,933 | A | 4/2000 | McLaughlin | |
| 6,112,354 | A * | 9/2000 | Stoltz et al. | 15/1.7 |
| 6,122,794 | A | 9/2000 | Atkins | |
| 6,226,826 | B1 | 5/2001 | Rice et al. | |
| 7,434,285 | B1 | 10/2008 | Chang | |
| 2007/0136962 | A1 | 6/2007 | Sebor | |
| 2007/0261183 | A1 | 11/2007 | Moore et al. | |
| 2008/0256727 | A1 * | 10/2008 | Van Der Meijden et al. | 15/1.7 |

OTHER PUBLICATIONS

International Search Report and Written Opinion dated Mar. 31, 2011 in related Application No. PCT/US2011/022182.

* cited by examiner

*Primary Examiner* — Randall Chin
(74) *Attorney, Agent, or Firm* — Dean W. Russell; Kilpatrick Townsend & Stockton LLP

(57) ABSTRACT

Detailed are swimming pool cleaners and components including discs and bumpers. Discs may include upwardly-extending hooks or similar features connecting directly with the bumpers. The direct connections additionally may be configured to allow substantial (i.e. non-trivial) upward movement of the discs from their normal locations while preventing substantial downward movement of the discs that might cause the discs undesirably to fold in use.

10 Claims, 5 Drawing Sheets

SWIMMING POOL CLEANERS AND COMPONENTS THEREOF

FIELD OF THE INVENTION

This invention relates to swimming pool cleaners and more particularly, although not necessarily exclusively, to discs and bumpers of such cleaners.

BACKGROUND OF THE INVENTION

U.S. Pat. No. 5,465,443 to Rice, et al., illustrates and describes various discs (and other components) of automatic swimming pool cleaners (APCs). The discs of the Rice patent typically are flexible, unitary structures defining central apertures for receiving footpads of APCs. Disc flexibility is advantageous for many reasons; flexible discs may bend when vertical or angled walls are encountered, for example, and adhere better to bottom surfaces of pools when surrounding areas are evacuated. Flexible discs additionally may more easily ride over objects extending upward from the bottom surfaces of pools as the APCs traverse those surfaces.

Many existing discs have upper surfaces that are mostly, if not entirely, planar. This is true for discs illustrated in the Rice patent, in which only peripheral fins extend upward from the upper surfaces. Regions of the upper surfaces adjacent the central apertures, by contrast, lack upwardly-extending protrusions. See, e.g., Rice, FIG. 6.

U.S. Patent Application Publication No. 2007/0261183 of Moore, et al., depicts additional discs and other components of APCs. Unlike discs of the Rice patent, those of the Moore application are not necessarily unitary structures, but instead may be formed of multiple parts. As illustrated, the discs may comprise forward, mid-, and rear sections. Although all sections are, to substantial extent, flexible, the mid- and rear sections beneficially are more flexible than are the forward sections. As noted in the Moore application, "Enhanced rigidity of [the] forward section additionally inhibits its assuming the shape of a corner or other transition within a pool . . . and prevents [the] forward section from folding under itself when departing from vertical surfaces such as walls." See Moore, p. 3, col. 2, ¶ 0045 (numerals omitted). In turn, the greater flexibility of the mid- and rear sections provides improved sealing of the disc to surfaces and may improve the ability of APCs to climb pool walls. See id., ¶ 0046. However, notwithstanding enhanced rigidity of the forward section, it nevertheless may, at times, fold under itself in use.

Like the discs of the Rice patent, those of the Moore application have generally planar upper surfaces. This is especially true for the mid- and rear sections of the discs. It likewise is true for the forward sections of the discs, although upwardly-extending peripheral fins again are shown.

U.S. Pat. No. 6,049,933 to McLaughlin shows yet other APCs having bodies to which flexible discs may be attached via footpads. Also illustrated as attached to the bodies are bumper assemblies, which often function as leading edges of the cleaners. The exemplary bumper assemblies of the McLaughlin patent may include bumpers comprising main frame and fins. Whereas the fins are normally composed of flexible material, the main frames are substantially rigid. See McLaughlin, col. 2, ll. 50-67.

As depicted especially in FIG. 2 of the McLaughlin patent, no direct connection between the disc and bumper assembly exists. This is consistent with conventional designs of APCs, in which the generally planar surfaces of discs are configured intentionally to be unfettered. Indeed, past efforts of restricting (nominally vertical) movement of the generally planar surfaces have resembled the systems of U.S. Pat. No. 5,014,382 to Kallenbach, in which weight retainers separate from the discs have been used to "stop" upward movement of the discs.

SUMMARY OF THE INVENTION

The present invention provides discs which, contrary to conventional approaches, may be connected directly to bumpers (or similar equipment) of APCs. Particularly—although not exclusively—useful for forward sections of discs of the Moore application, the invention allows the sections to be connected mechanically to bumpers of the cleaners. Such mechanical connections provide additional support for the forward sections, reducing possible tendency of the sections to fold in use.

Moreover, certain preferred versions of the invention are configured to allow non-trivial upward movement of the forward sections while still preventing non-trivial movement downward that might result in folding. These results may be achieved by providing an inverted "J"-shaped hook of limited flexibility extending upward from a disc and two spaced openings in a bumper in which the hook may be received. Whereas upward movement of the disc is not materially impeded by the interaction between the hook and bumper, downward movement is. Preferably the hook is molded as part of the disc, although it instead may be connected or attached thereto.

It thus is an optional, non-exclusive object of the present invention to provide novel swimming pool cleaners and components thereof.

It is an additional optional, non-exclusive object of the present invention to provide discs for APCs.

It is another optional, non-exclusive object of the present invention to provide discs for APCs that, in use, may be connected directly to components of the cleaners such as bumpers.

It is a further optional, non-exclusive object of the present invention to provide discs for APCs having hooks extending upward from generally planar surfaces of the discs.

It is, moreover, an optional, non-exclusive object of the present invention to provide discs for APCs in which the hooks are molded together with the remainders of the discs.

It is also an optional, non-exclusive object of the present invention to provide discs for APCs in which the hooks resemble inverted "J"s which are received by openings of corresponding bumpers of the APCs.

Other objects, features, and advantages of the present invention will be apparent to those skilled in appropriate fields with reference to the remaining text and the drawings of this application.

DETAILED DESCRIPTION

Figure 4:
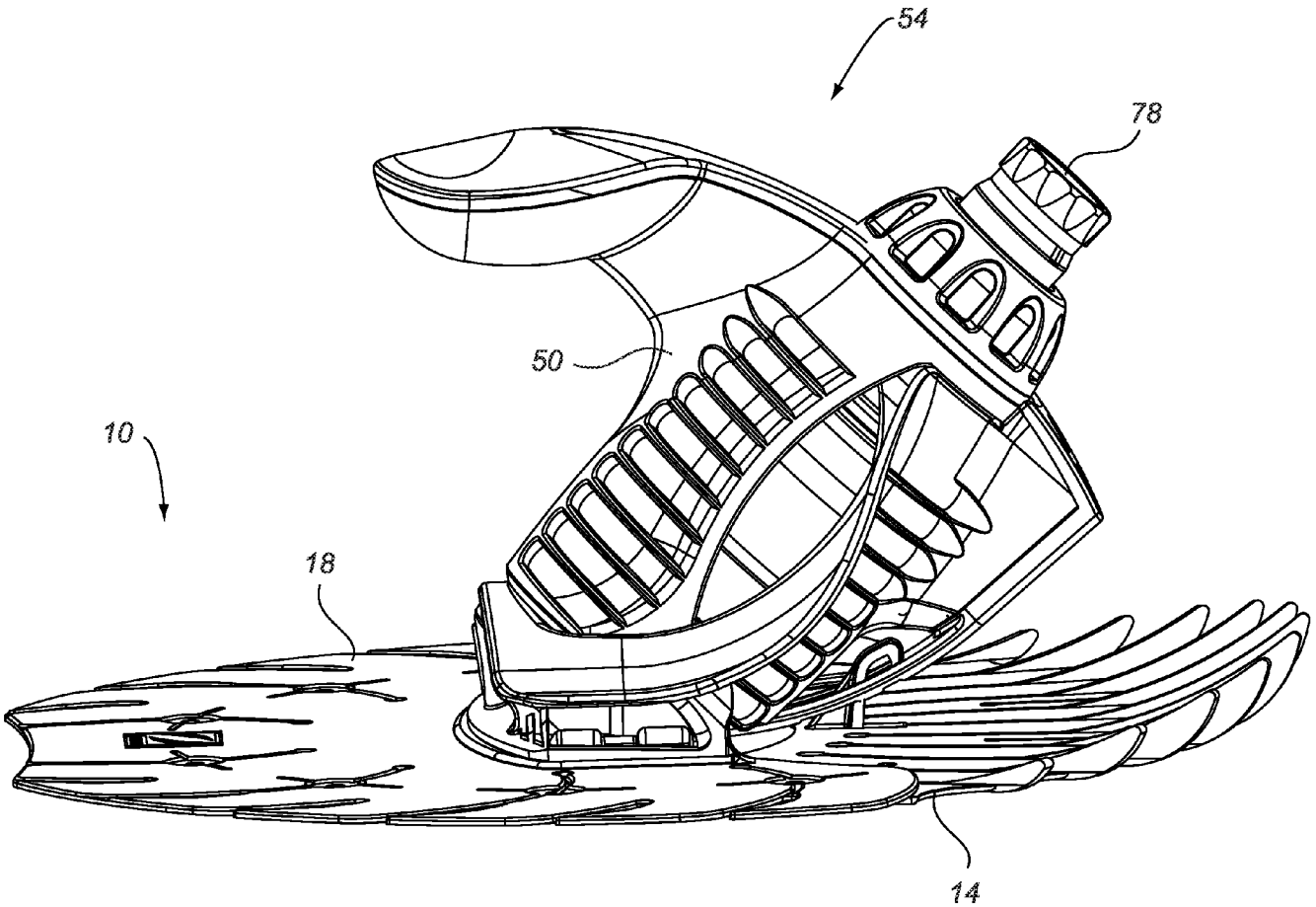
FIG. 4 is a perspective view of an exemplary APC of the present invention including the disc section of FIG. 1 and the bumper component of FIG. 3.
Figure 5:
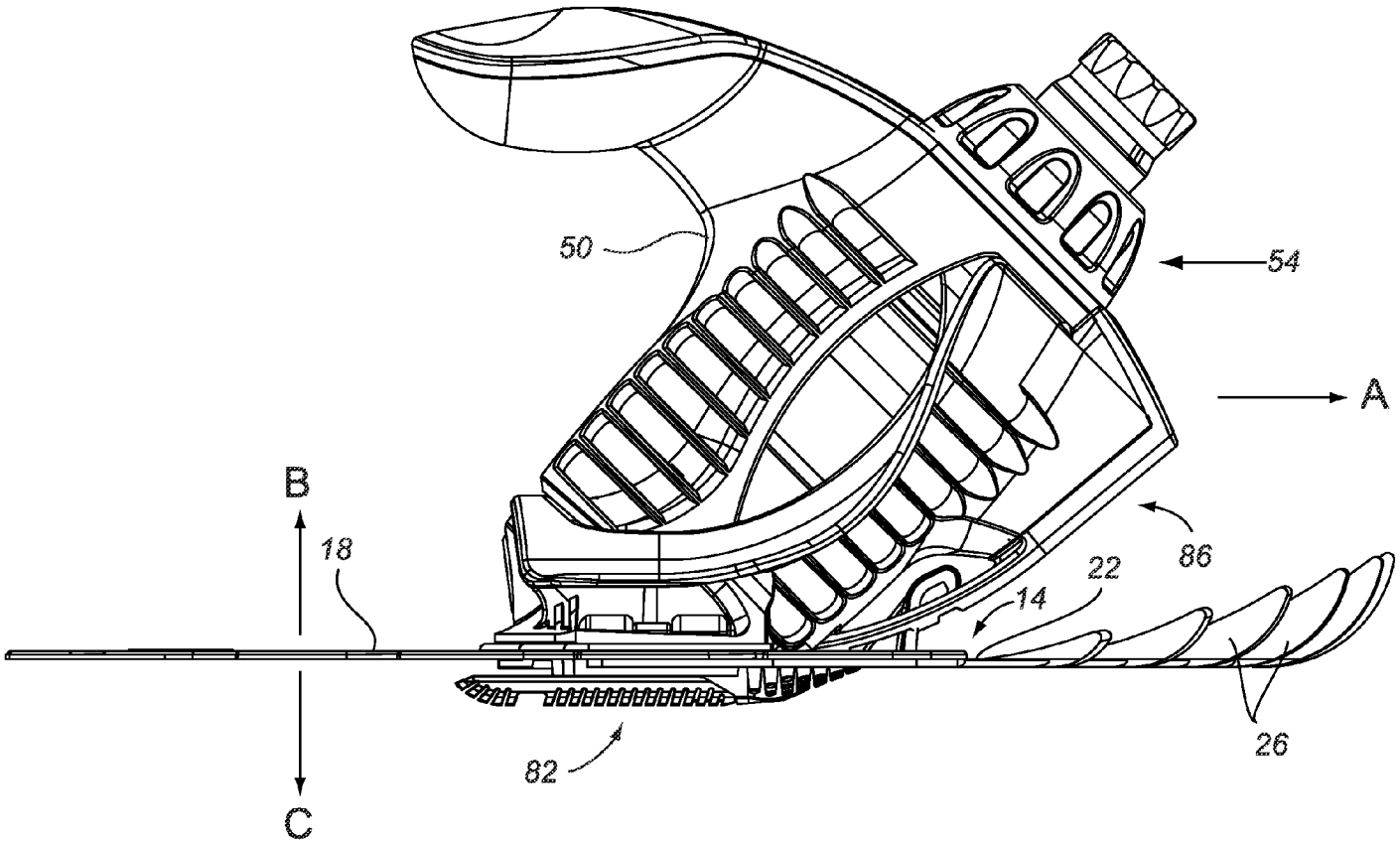
FIG. 5 is an elevational view of portions of the APC of FIG. 4.

Illustrated in FIGS. 4-5 is exemplary disc 10 of the present invention. Disc 10 may be similar to the multi-section discs described in the Moore application. Alternatively, disc 10 may comprise forward section 14 and rear section 18 as shown in FIGS. 4-5. Yet alternatively, disc 10 may be a unitary structure (or otherwise).

Figure 1:
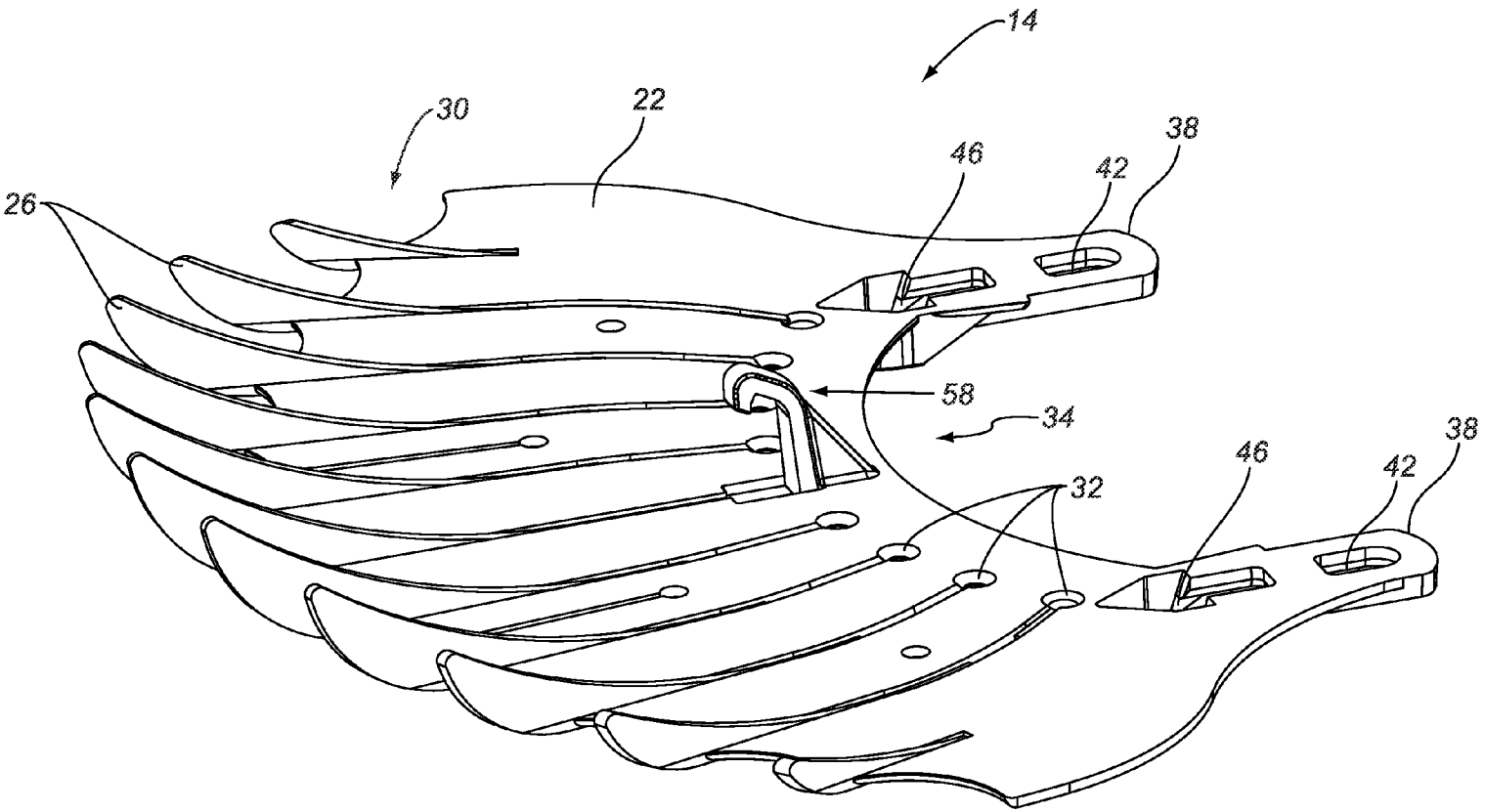
FIG. 1 is a perspective view of a section of an exemplary disc of the present invention.
Figure 2:
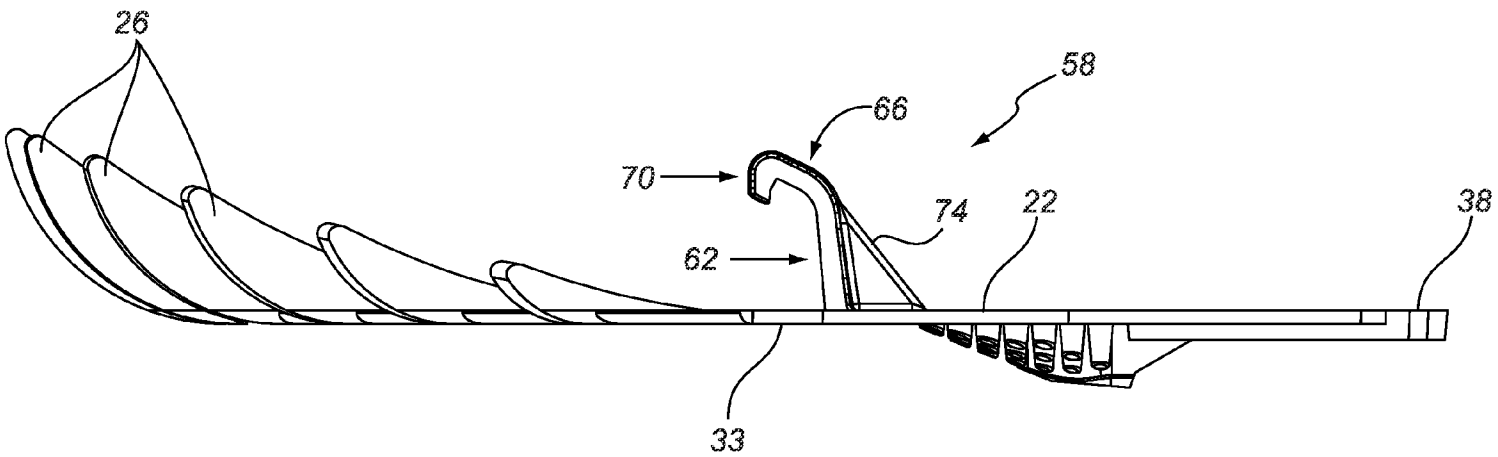
FIG. 2 is an elevational view of the disc section of FIG. 1.

Forward section 14 of disc 10 is depicted additionally in FIGS. 1-2. Forward section 14 may, if desired, be similar to the forward section detailed in the Moore application. In particular, forward section 14 may have an upper surface 22 that is generally planar and from which fins 26 extend upward at or adjacent outer periphery 30. Section 14 additionally may include apertures 32, any or all of which may be remote from the outer periphery 30, and may define lower surface 33 and inner periphery 34. Included in the region of inner periphery 34 may be tongues 38, each containing openings 42 and 46. In use, openings 42 and 46 may receive portions of a footpad (such as that of the Moore application) to connect forward section 14 directly or indirectly to body 50 of cleaner 54.

Unlike the forward sections of the discs of the Moore application, forward section 14 includes member 58. Member 58 preferably extends upward from upper surface 22 at or adjacent inner periphery 34, thus effecting a discontinuity in the generally planar nature of the upper surface 22. Furthermore, member 58 preferably is molded as part of forward section 14 and therefore integral therewith. Alternatively, however, member 58 may be adhered or connected to section 14 in any appropriate manner.

In versions of forward section 14 depicted in FIGS. 1-2 and 4-5, member 58 resembles a hook or an inverted letter "J." In particular, member 58 may comprise upstanding base 62, transition region 66, and flange 70. Base 62 may include gusset 74 for additional strength and support, although the presence of gusset 74 is not required.

Cleaner 54, in the form of an APC, appears in FIGS. 4-5. Cleaner 54 typically (but not necessarily) is a "suction-type" hydraulic APC, with outlet 78 of body 50 connected to a hose in fluid communication with a pump of a swimming pool filtration system. The pump evacuates body 50, depressing at least portions of lower surface 33 of disc 10 onto a surface of the pool and drawing debris-laden water from the pool into the body 50 through inlet region 82. At some location between inlet region 82 and the pump, the water is mechanically filtered to remove some, if not all, of the debris entrained therein. Likewise at a location between inlet region 82 and the pump, a valve will be positioned and operated so as periodically to interrupt the flow of water. The periodic flow interruption produces a water-hammer effect, causing cleaner 54 to move about the pool.

Body 50 may include, among other things, bumper 86. Because cleaner 54 frequently moves in the direction of arrow A in FIG. 5, bumper 86 usually forms the leading edge of body 50. Bumper 86 thus at times may function as a wear surface of body 50 or operate to deflect cleaner 54 into a different direction of movement upon encountering, for example, an obstacle within a pool.

Figure 3:
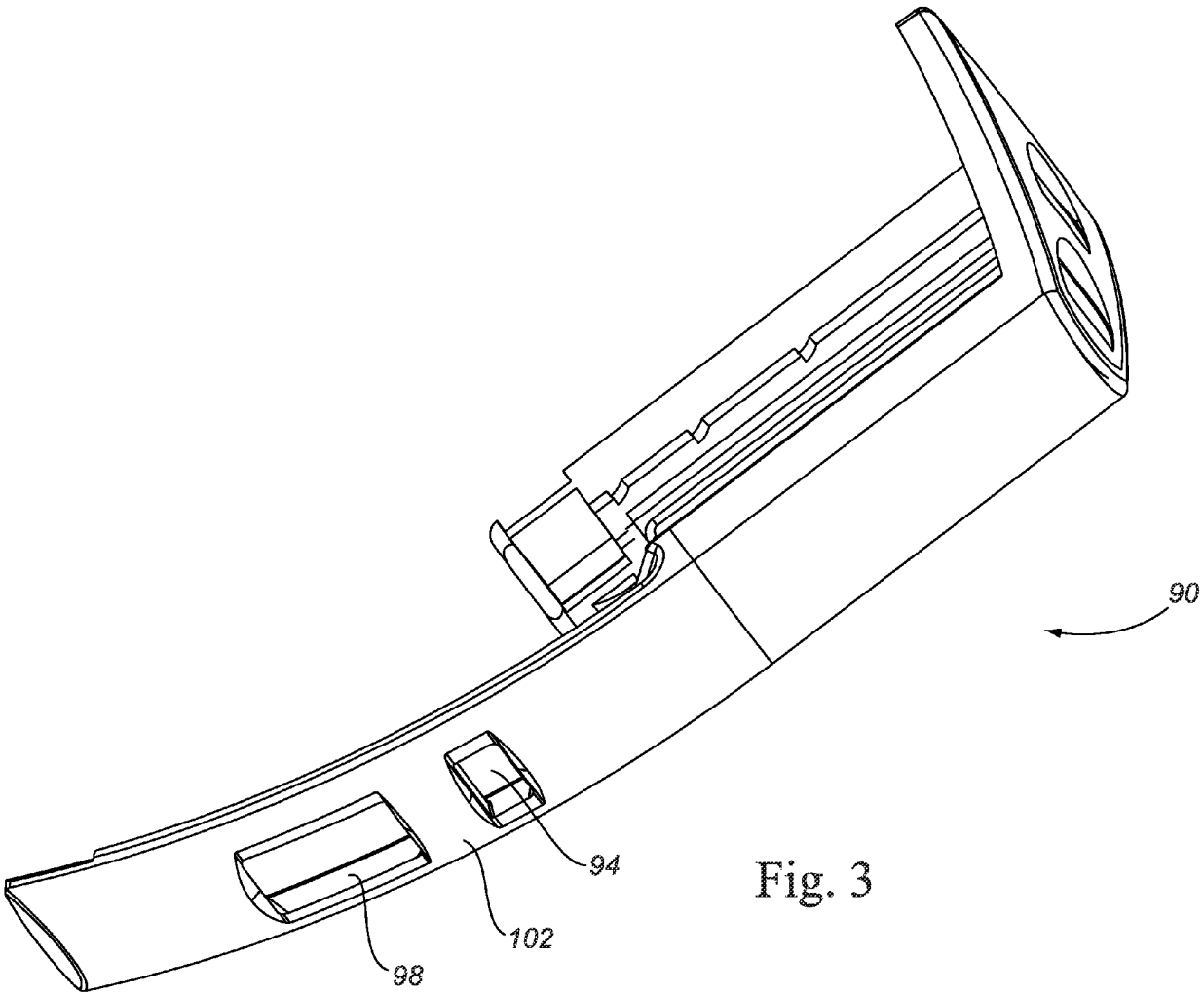
FIG. 3 is a perspective view of an exemplary bumper component of the present invention.

Beneficially included as part of bumper 86 is component 90 of FIG. 3. Although component 90 preferably is removably attached to the remainder of bumper 86 (so as to receive member 58 in the manner described below prior to attachment), it may instead be integrally formed therewith. In either circumstance, component 90 may define spaced first opening 94 and second opening 98. As shown in FIG. 3, first opening 94 and second opening 98 preferably are separated by solid region 102, although an opening of restricted width alternatively may provide the separation.

First opening 94 may be sized so as to receive flange 70 of member 58. Second opening 98, by contrast, may be sized so as to receive base 62. The length of solid region 102 may be approximately equal to the length of transition region 66.

FIGS. 4-5 depict exemplary interrelationship between member 58 and component 90. As shown in these figures, base 62 has been received by second opening 98. Such reception preferably is permanent whenever cleaner 54 is operating. Stated differently, base 62 preferably remains received by second opening 98 whenever cleaner 54 is in use.

By contrast, flange 70 is positioned above first opening 94, and transition region 66 is located above—and thus not in contact with—solid region 102. Interaction between member 58 and component 90 hence itself does not inhibit upward movement (see arrow B) of forward section 14. Indeed, in some versions of the invention, such upward movement may occur until upper surface 22 itself contacts component 90.

However, as forward section 14 moves downward (see arrow C), flange 70 moves toward first opening 94 and transition region 66 moves toward solid region 102. Further downward movement initially causes first opening 94 temporarily to receive flange 70 and thereafter causes transition region 66 to contact solid region 102. This contact inhibits yet further downward movement of forward section 14; i.e. solid region 102 functions as a downward limiter or "stop" for forward section 14.

Limiting movement of forward section 14 in this manner allows sufficient downward movement to occur to permit depression of forward section 14 onto a to-be-cleaned surface as body 50 is evacuated yet prevents undue downward movement that might cause portions of forward section 14 to fold under the remainder of the forward section 14.

The foregoing is provided for purposes of illustrating, explaining, and describing embodiments of the present invention. Modifications and adaptations to these embodiments will be apparent to those skilled in the art and may be made without departing from the scope or spirit of the invention. For example, member 58 need not necessarily be located in a forward section of a disc, but instead may be located (or additional members 58 may be located) elsewhere on the disc. Likewise, member 58 need not necessarily interact with a component of a bumper, but rather may interact with other components of cleaner 54. Moreover, directional roots and terms (e.g. "up," "down," "forward," "rear," "above," etc.) are used herein solely for convenience of the reader in interpreting the drawings of the application, which generally depict cleaner 54 in an upright orientation. In use cleaner 54 may be oriented otherwise as, for example, when it climbs a wall of a pool, negotiates steps within a pool, encounters certain obstacles in the pool, or travels on sloped surfaces. Finally, the contents of the Rice, McLaughlin, and Kallenbach patents and of the Moore application are incorporated herein in their entireties by this reference.

What is claimed is:

1. A flexible disc configured in use to connect directly or indirectly to a footpad associated with a body of an automatic swimming pool cleaner, the disc comprising:

a. an upper surface;

b. an outer periphery defining a leading edge of the disc in use;

c. an inner periphery opposite the disc from the outer periphery; and d. a member, in the form of a hook, extending from the upper surface and located (i) remote from the outer periphery and (ii) at or adjacent the inner periphery.

2. A disc according to claim 1 in which the member is integral with the upper surface.

3. A disc according to claim 2 in which the upper surface has a portion that is generally planar, with the member effecting a discontinuity in the generally planar nature of the portion.

4. A disc according to claim 3 in which the member comprises a base, a transition region, and a flange.

5. A disc according to claim 4 in which the base includes a gusset.

6. An automatic swimming pool cleaner comprising:

a. a body comprising a bumper defining first and second openings separated by a solid region; and b. a flexible disc attached directly or indirectly to or integrally formed with the body, the flexible disc comprising an upper surface and a member, in the form of a hook, extending from the upper surface, the member comprising a base, a transition region, and a flange; and in which (i) the second opening receives the base and (ii) the first opening is configured to receive the flange when certain movement of the disc occurs in a first direction.

7. A cleaner according to claim 6 in which the transition region contacts the solid region when certain movement of the disc occurs in the first direction, such contact preventing further movement of the disc in the first direction.

8. A cleaner according to claim 7 in which the transition region does not contact the solid region when movement of the disc occurs in a second direction opposite the first direction.

9. A cleaner according to claim 8 in which the disc comprises separate forward and rear sections, each having an upper surface, and the member extends from the upper surface of the forward section.

10. A cleaner according to claim 9 further comprising a footpad and in which the forward section comprises at least one tongue for connecting to the footpad.

* * * * *